US005575393A

United States Patent [19]

Gebhardt

[11] Patent Number: 5,575,393

[45] Date of Patent: Nov. 19, 1996

[54] STACK OF COLD WELDED HEADERLESS BAGS

[75] Inventor: Terry D. Gebhardt, Longview, Tex.

[73] Assignee: TC Manufacturing Co., Inc., Evanston, Ill.

[21] Appl. No.: 508,720

[22] Filed: Jul. 28, 1995

[51] Int. Cl.[6] ..... B65D 85/62

[52] U.S. Cl. ..... 206/554; 383/37

[58] Field of Search ..... 493/186, 187, 493/264, 268; 383/37, 210; 206/554, 813

[56] References Cited

U.S. PATENT DOCUMENTS

| | | |
|---|---|---|
| 538,712 | 5/1895 | Stuart . |
| 808,864 | 1/1906 | McLaughlin . |
| 981,639 | 1/1911 | Hall . |
| 2,205,298 | 11/1938 | Linder . |
| 3,263,347 | 2/1964 | McCutcheon . |
| 3,312,339 | 6/1964 | Million . |
| 3,385,428 | 10/1966 | Kugler . |
| 3,402,749 | 3/1967 | Kinzler . |
| 3,685,645 | 8/1972 | Kawaguchi . |
| 3,771,645 | 11/1973 | Wendel . |
| 3,777,930 | 12/1973 | Ericson et al. . |
| 3,889,871 | 6/1975 | White . |
| 3,918,589 | 11/1975 | Nausedas . |
| 4,046,257 | 9/1977 | Lehmacher . |
| 4,175,602 | 11/1979 | Cavalaris et al. . |
| 4,290,467 | 9/1981 | Schmidt . |
| 4,305,503 | 12/1981 | Membrino . |
| 4,406,371 | 9/1983 | Membrino . |
| 4,458,466 | 7/1984 | Carbone et al. . |
| 4,485,929 | 12/1984 | Betts, Sr. . |
| 4,527,693 | 7/1985 | Membrino . |
| 4,529,090 | 7/1985 | Pilon . |
| 4,543,084 | 9/1985 | Bailey . |
| 4,557,384 | 12/1985 | Membrino . |
| 4,560,068 | 12/1985 | Membrino . |
| 4,576,316 | 3/1986 | Foster . |
| 4,586,319 | 5/1986 | Ausnit . |
| 4,611,719 | 9/1986 | Dudek et al. . |
| 4,630,311 | 12/1986 | Benston . |
| 4,635,294 | 1/1987 | Bensten . |
| 4,651,504 | 3/1987 | Bensten . |
| 4,665,552 | 5/1987 | Lems et al. . |
| 4,699,607 | 10/1987 | Lambrecht . |
| 4,733,780 | 3/1988 | Jensen . |
| 4,734,148 | 3/1988 | Meyer . |
| 4,769,126 | 9/1988 | Roen et al. . |
| 4,811,418 | 3/1989 | Reifenhauser . |
| 4,846,586 | 7/1989 | Bruno . |

(List continued on next page.)

FOREIGN PATENT DOCUMENTS

| | | |
|---|---|---|
| 270432 | 4/1964 | Australia . |
| 801563 | 12/1968 | Canada . |
| 850483 | 9/1970 | Canada . |
| 1341587 | 9/1962 | France . |
| 2408831 | 2/1974 | Germany . |
| 1-97625 | 4/1989 | Japan . |

OTHER PUBLICATIONS

Pak–Sher "Quicksack" Packaging System Featuring Pacene Film Brochure.

ITW Minigrip Stock Bag Brochure–Jun. 1988.

*Primary Examiner*—Jacob K. Ackun

*Attorney, Agent, or Firm*—Lee, Mann, Smith, McWilliams, Sweeney & Ohlson

[57] ABSTRACT

A stack of a plurality of headerless plastic bags are assembled together for individual dispensing. Each bag comprises a front wall having a first body portion and a first lip and a rear wall attached to the front wall. The rear wall includes a second body portion which overlies the first body portion of the front wall and a rear lip which extends beyond the front lip of the front wall. The bags are collated into a stack and are removably joined to one another by forming a cold weld in and between the rear lips of the rear wall of adjacent bags. The cold welds are formed by pressing the rear lips of the bags together under pressure, but without the application of heat. The cold welds join the plurality of bags in the stack together until the cold welds which join a particular bag to the stack are severed. Each bag is dispensed in its entirety without any residual waste.

11 Claims, 1 Drawing Sheet

U.S. PATENT DOCUMENTS

| | | | |
|---|---|---|---|
| 4,854,451 | 8/1989 | Jensen . | |
| 4,863,285 | 9/1989 | Claxton . | |
| 4,877,473 | 10/1989 | Snowdom et al. . | |
| 4,904,092 | 2/1990 | Campbell et al. . | |
| 4,995,860 | 2/1991 | Wilfong, Jr. . | |
| 5,005,695 | 4/1991 | Tennefos et al. . | |
| 5,014,852 | 5/1991 | Herringtom et al. . | |
| 5,033,868 | 7/1991 | Peppiatt . | |
| 5,094,707 | 3/1992 | Bruno . | |
| 5,100,000 | 3/1992 | Huseman . | |
| 5,118,202 | 6/1992 | Bruno . | |
| 5,207,328 | 5/1993 | Bose et al. | 206/554 |
| 5,309,698 | 5/1994 | Huseman . | |
| 5,377,570 | 1/1995 | Giljam . | |
| 5,419,437 | 5/1995 | Huseman . | |

10
12
14
16
18
20
30
32
34
36
38
40
42
44
50
52
54
60
62
70
72
76
80A
80B
84
86
88

STACK OF COLD WELDED HEADERLESS BAGS

BACKGROUND OF THE INVENTION

The present invention is directed to headerless zipper closure bags which are assembled together in a stack for mounting on a dispenser for individual dispensing of bags, and in particular to a stack of a plurality of headerless bags which are removably joined together by one or more cold welds.

Plastic bags of various types have been manufactured and used for holding and storing various types of goods and products from hardware to food products. Plastics bags have also been manufactured with zippers which permit the bag to be selectively opened and closed. Prior plastic bags have been manufactured as individual bags, as a strip of a plurality of bags with the bags being attached end to end by a perforated portion which allows selective separation of the bags, or as a stack of a plurality of bags with each bag joined to an adjacent bag through a header. A stack of bags is shown in U.S. Pat. No. 5,419,437 as including a plurality of bags wherein each bag includes a header portion which is attached to the header portion of an adjacent bag by mechanical fasteners, such as staples, or by heat sealing, such as by extending a hot needle through the adjacent header portions such that the headers are attached by the melted plastic. Each bag is dispensed by separating it from its header portion. Once all of the bags in the stack have been dispensed the header portions of all of the bags remain as waste which must be disposed. The present invention provides a stack of plastic bags which are removably attached to one another without the use of a header thus eliminating waste while allowing easy separation of an entire bag from the stack of bags.

SUMMARY OF THE INVENTION

The present invention provides a stack of a plurality of headerless plastic bags which are assembled and joined together for mounting on a dispenser device and for individual dispensing of the bags. Each bag comprises a front wall and a rear wall attached to the front wall. The front wall includes a first body portion and a front lip having a first terminal edge. The rear wall includes a second body portion and a rear lip having a second terminal edge. The first body portion of the front wall overlies the second body portion of the second wall such that a chamber is defined therebetween which is adapted to receive one or more products. The rear lip of the rear wall extends from the second body portion beyond the first terminal edge of the front wall. A first closure member is located on the front wall and a complementary second closure member is located on the rear wall. The first and second closure members form a zipper which provides for the selective opening and closing of an opening to the chamber.

A plurality of the plastic bags are collated and assembled into a stack such that all of the bags are similarly oriented and such that the rear lip of each bag is in contact with the rear lip of an adjacent bag. A cold weld is formed in and between the rear lips of adjacent bags thereby removably joining each bag to an adjacent bag such that the stack of bags is a single unit. The cold welds are formed by pressing the rear lips of the bags together under pressure, but without the application of heat. The cold welds form a severable connection between the rear lips of adjacent bags such that an entire bag may be easily separated from an adjacent bag by pulling on any portion of the bag. Slits or apertures are formed in the rear lip of each bag which extend through the stack of bags to provide for the mounting of the stack of bags on a dispenser. The cold welds maintain the slits or apertures in the bags in alignment such that the stack of bags may be easily mounted on the dispenser device as a single unit for the individual dispensing of the bags. Each bag is separated and removed from the stack in its entirety such that when all of the bags have been dispensed there is no remaining waste.

DETAILED DESCRIPTION OF THE PREFERRED EMBODIMENT

Figures 1, 2, 3, 4:
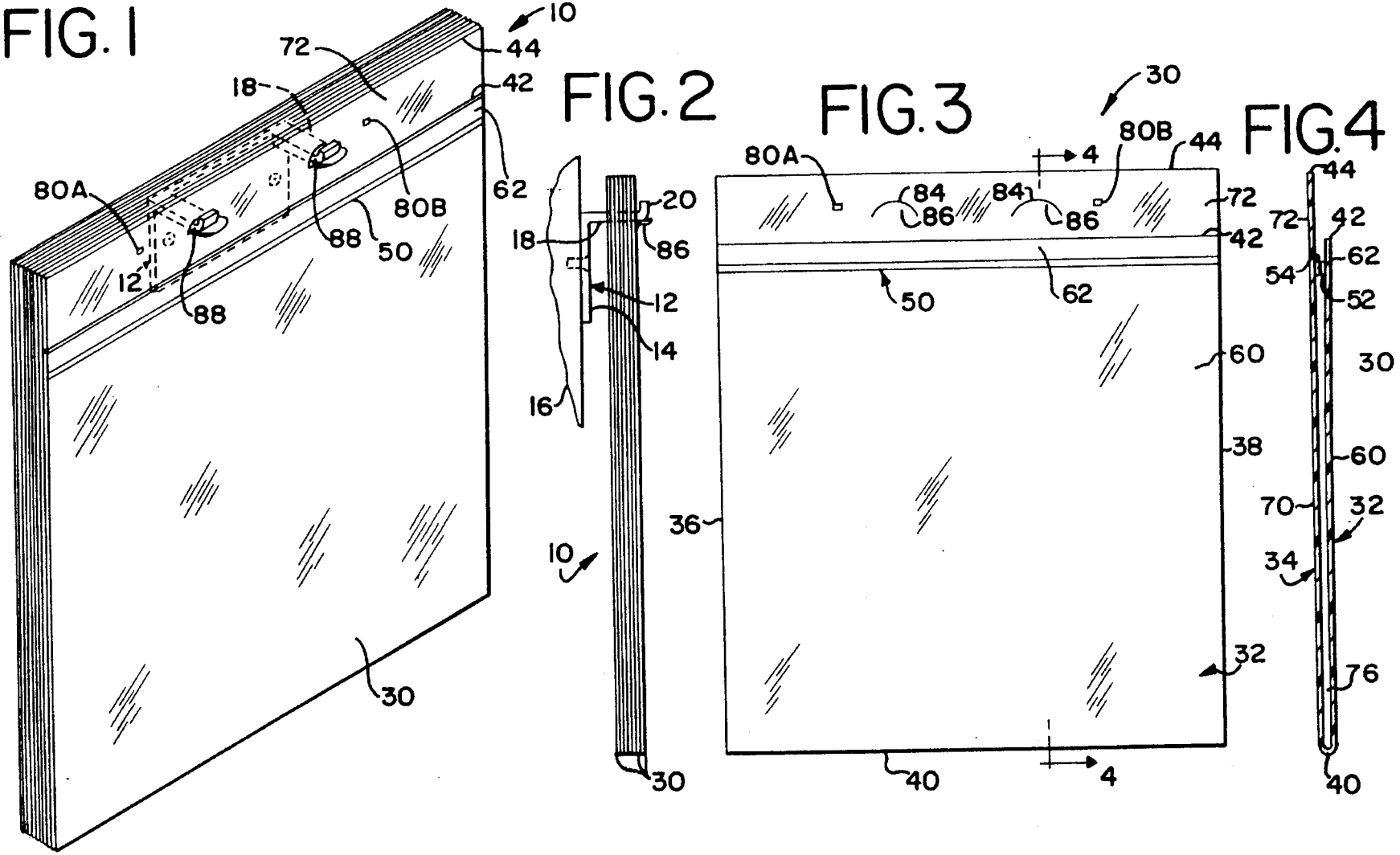
FIG. 1 is a perspective view of the stack of plastic bags of the present invention shown mounted on a dispenser.
FIG. 2 is a side elevational view of the stack of plastic bags shown mounted on a dispenser.
FIG. 3 is a front elevational view of a bag which forms a part of the stack of bags.
FIG. 4 is a cross sectional view taken along lines 4—4 of FIG. 3.

The stack of bags 10 of the present invention is shown in FIGS. 1 and 2 removably mounted on a dispenser 12. The dispenser 12 includes a base 14 which is adapted to be mounted to a support member 16 such as a wall, cabinet or other structure by an adhesive or mechanical fastener. The dispenser 12 also includes a pair of spaced apart support members 18 which extend generally horizontally from the base 14. Each support member 18 includes an upwardly extending tip 20 at the end of each support member 18. The dispenser 12 may be formed in various other configurations as desired.

The stack of bags 10 includes a plurality of individual headerless plastic bags 30 which are joined together. As best shown in FIGS. 3 and 4, each bag 30 includes a front wall 32 attached to a rear wall 34. The front wall 32 is attached to the rear wall 34 along a left edge 36, a right edge 38, and a bottom edge 40 of the bag 30. The front wall 32 and the rear wall 34 are heat sealed to one another along the left edge 36 and the right edge 38. The front wall 32 and the rear wall 34 are attached to one another along the bottom edge 40 by a fold line or by heat sealing. The front wall 32 extends from the bottom edge 40 to an upper first terminal edge 42 which is generally linear and parallel to the bottom edge 40. The rear wall 34 extends from the bottom edge 40 to an upper second terminal edge 44 which is generally linear and parallel to the bottom edge 40. The front and rear walls 32 and 34 are preferably formed from sheets of plastic such as high density polyethylene or other types of plastic as may be desired. The front and rear walls 32 and 34 may be approximately 1¼ mils thick, or various other thicknesses as desired.

Each bag 30 includes a zipper 50 having a male closure member 52 and a complementary female closure member 54. The male closure member 52 is attached to the interior surface of the front wall 32 and is spaced apart from and extends generally parallel to the bottom edge 40 between the left edge 36 and fight edge 38. The female closure member 54 is attached to the interior surface of the rear wall 34 and is spaced apart from and extends generally parallel to the bottom edge 40 between the left edge 36 and fight edge 38. The female closure member 54 is located opposite the male closure member 52. Alternatively, the male closure member 52 may be located on the rear wall 34 and the female closure member 54 may be located on the front wall 32. The closure members 52 and 54 may be extruded into the front and rear walls 32 and 34 or may be laminated thereon. The male and female closure members 52 and 54 may be pressed together such that they releasably interlock with one another to form a seal therebetween. The closed or interlocked closure members 52 and 54 may be selectively separated to form an opening therebetween. Alternatively, each bag 30 may be formed without a zipper 50 if desired.

As best shown in FIG. 4, the front wall 32 includes a first body portion 60 which is generally planar and which extends between the bottom edge 40 and the closure member 52 and between the left edge 36 and right edge 38 of the bag 30. The front wall 32 also includes a front lip 62 which extends outwardly from the first body portion 60 and the closure member 52 to the first terminal edge 42 and between the left edge 36 and right edge 38 of the bag 30. The front lip 62 provides a gripping member for applying a force to the front wall 32 to separate the closure member 52 from the closure member 54 and thereby provide an opening therebetween into the chamber 76. The first terminal edge 42 of the front wall 32 is free and unattached, other than that it may be attached at one end to the left edge 36 and at the opposing end to the right edge 38 of the bag 30, as the front wall 32 does not extend beyond the first terminal edge 42.

The rear wall 34 includes a second body portion 70 which is substantially planar and which extends between the bottom edge 40 and the closure member 54 and between the left edge 36 and the right edge 38 of the bag 30. The first body portion 60 and the second body portion 70 are of generally the same size and overlie one another thereby creating a chamber 76 located therebetween. The rear wall 34 also includes a rear lip 72 which extends outwardly from the second body portion 70 and the closure member 54 to the second terminal edge 44. The second terminal edge 44 of the rear lip 72 is free and unattached. The rear wall 34 does not extend beyond the terminal edge 44 and the terminal edge 44 is not attached to, nor does it form a part of, a removable header. Neither does the rear lip 72 include a perforated score or tear line. The front lip 62 overlies a portion of the rear lip 72. The rear lip 72, however, extends beyond the front lip 62 such that a substantial area of the rear lip 72 is not covered by the front lip 62.

A plurality of the bags 30 are collated into a stack wherein each bag is oriented in the same manner relative to each of the other bags. Once the bags 30 are collated and assembled into a stack, the rear lip 72 of each bag 30 is joined or attached to the rear lip 72 of an adjacent bag 30 with a first cold weld 80A and a second cold weld 80B. However, only one cold weld or additional cold welds may be used as desired. Each cold weld 80A–B is located in the portion of the rear lip 72 which is not covered by the front lip 62. The cold welds 80A–B are located approximately equal distances below the terminal edge 44 of the rear wall 4. The cold welds 80A and 80B are spaced apart from one another such that they are each located approximately one-quarter of the width of the bag 30 from the respective left and right edges 36 and 38 of the bag 30. The cold welds may be placed at other locations as desired across the width of the rear lip 72 as desired. The cold welds 80A-B are formed by pressing portions of the rear lips 72 of the bags 30 against one another with a punch in a stamping mechanism such as described in U.S. Pat. Nos. 4,877,473 and 4,995,860 which are incorporated herein by reference. The portions of the adjacent rear lips 72 which are pressed together become fused together such that the rear lip 72 of each bag 30 is joined to the rear lip 72 of an adjacent bag 30. The cold welds 80A–B are formed at ambient temperatures without the application of heat to the punch or the bags 30. The size of each cold weld 80A–B is preferably less than a one-eighth inch diameter circle, although larger cold welds may be used.

Once the bags 30 are assembled into the stack of bags 10, one or more elongate slits 84 may be cut into the rear lip 72 of each bag 30 as best shown in FIG. 3. Each bag 30 preferably includes two slits 84 which are generally semicircular in shape and which are spaced apart from one another by a distance equal to the spacing of the support members 18 of the dispenser 12. The slits 84 are located in the uncovered portion of the rear lip 72 which is not covered by the front lip 62. The slits 84 form respective flaps 86 which are bendable about the base of the flaps such that an aperture 88 is formed through the rear lip 72 by each slit 84 as best shown in FIG. 1. Other than the mounting apertures 88 and any small holes that may be formed in the rear lip 72 during the formation of the cold welds 80A–B by the punch, the rear lip 72 is substantially nonperforate. The stack of bags 10 is adapted to be mounted onto the dispenser 12 by inserting the support members 18 through respective apertures 88 formed by the slits 84 as shown in FIGS. 1 and 2. The cold welds 80A-B maintain the bags 30 of the stack 10, and the slits 84 and apertures 88 formed therein, in alignment to facilitate the insertion of the support members 18 through the apertures 88 in each bag 30 while mounting a stack of bags 10 on the dispenser 12.

In operation, one or more stacks of bags 10 are mounted onto a dispenser 12 by inserting the support members 18 of the dispenser 12 through the apertures 88 in the bags 30. Once the stack of bags 10 is mounted on the dispenser 12, the cold welds 80A–B may be severed between each adjacent bag 30 when desired as the cold welds 80A–B have served their purpose in facilitating the easy mounting of a plurality of bags 30 onto the dispenser 12. The cold welds 80A–B between two bags 30 may be severed by pulling on the front lip 62, rear lip 72, bottom edge 40, or other portion of one bag 30 away from the adjacent bag 30. An entire bag 30 may thereby be severed from the stack 10 for individual dispensing while the entire bag 30 and the rear lip 72 remain entirely intact. When it is desired to place a product within the chamber 76 of the first bag 30 in the stack of bags 10, the front lip 62 of the first bag 30 is grasped and pulled away from the rear wall 34 thereby separating the male closure member 52 from the female closure member 54 and providing an opening into the chamber 76. The desired product or products may be placed into the chamber 76 of a bag 30, and thereafter the closure members 52 and 54 may be interlocked with one another to close the opening to the chamber 76. The zipper 50 may be opened and/or closed prior to or after the bag 30 has been severed from the stack 10, and prior to or after the bag 30 is removed from the dispenser 12. Once each of the bags 30 in the stack 10 has been dispensed from the dispenser 12, there is no remaining waste left on the dispenser 12 that requires disposal as the bags 30 are headerless, and a fresh stack of bags 10 may be immediately placed on the dispenser 12.

Various features of the invention have been particularly shown and described in connection with the illustrated embodiment of the invention, however, it must be understood that these particular arrangements merely illustrate and that the invention is to be given its fullest interpretation within the terms of the appended claims.

What is claimed is:

1. A stack of bags adapted to be mounted on a dispenser comprising:

a plurality of bags assembled together for individual dispensing from the dispenser, each said bag including a front wall having a first body portion and a first terminal edge, and a rear wall attached to said front wall, said rear wall having a second body portion and a rear lip having a second terminal edge, said first body portion of said front wall overlying said second body portion of said second wall and defining a chamber therebetween adapted to receive one or more products, said rear lip of said rear wall extending from said second body portion beyond said first terminal edge of said front wall; and a cold weld removably attaching said rear lip of each said bag to an adjacent bag in the stack, said cold weld located in said rear lip of each said bag and being formed by pressing the rear lips of adjacent bags together, said cold weld between adjacent bags maintaining said bags in said stack in the proper orientation relative to one another to facilitate the mounting of said stack of bags onto the dispenser, said cold weld being selectively severable such that each bag may be selectively separated in its entirety from the stack for individual dispensing.

2. The stack of bags of claim 1 wherein each said bag includes a first closure member located on said front wall and a complementary second closure member located on said rear wall, said first and second closure members providing for the selective opening and closing of said chamber.

3. The stack of bags of claim 2 wherein said rear lip of said rear wall of each said bag extends outwardly from said second closure member.

4. The stack of bags of claim 3 wherein each said bag includes a front lip extending outwardly from said first closure member, said front lip overlying at least a portion of said rear lip.

5. The stack of bags of claim 4 wherein said first terminal edge of said front lip is spaced at a first distance from said first closure member and said second terminal edge of said rear lip is spaced at a second distance from said second closure member, said first distance being shorter than said second distance.

6. The stack of bags of claim 1 wherein said rear lip of each said bag includes a slit adapted to removably receive a support member of the dispenser.

7. The stack of plastic bags of claim 1 wherein said rear lip of each said bag includes an aperture adapted to removably receive a support member of the dispenser.

8. A method for forming a stack of a plurality of plastic bags with each bag being removably attached to an adjacent bag, the method comprising the steps of:

collating a plurality of plastic bags into a stack, each said bag having a front wall and a rear wall, said rear wall including a rear lip which extends beyond said front wall;

forming a cold weld between said rear lips of adjacent bags, said cold weld removably attaching the rear lip of each said bag to the rear lip of an adjacent bag.

9. The method of claim 8 wherein said cold weld is formed by pressing a portion of each said rear lip of each said bag against said rear lip of an adjacent bag.

10. The method of claim 9 wherein said cold weld is formed at ambient temperatures.

11. The method of claim 9 wherein said rear lips are pressed together by a punch.

* * * * *